US011680580B2

(12) United States Patent
Huang et al.

(10) Patent No.: US 11,680,580 B2
(45) Date of Patent: Jun. 20, 2023

(54) AXIAL-FLOW IMPELLER AND AIR-CONDITIONER HAVING THE SAME

(71) Applicants: GD MIDEA AIR-CONDITIONING EQUIPMENT CO., LTD., Foshan (CN); MIDEA GROUP CO., LTD., Foshan (CN)

(72) Inventors: Yutai Huang, Foshan (CN); Xujie Cai, Foshan (CN); Yushi Li, Foshan (CN); Bo Wang, Foshan (CN); Hejie Zhou, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 162 days.

(21) Appl. No.: 17/293,194

(22) PCT Filed: Apr. 26, 2019

(86) PCT No.: PCT/CN2019/084636
§ 371 (c)(1),
(2) Date: May 12, 2021

(87) PCT Pub. No.: WO2020/103400
PCT Pub. Date: May 28, 2020

(65) Prior Publication Data

US 2022/0003242 A1 Jan. 6, 2022

(30) Foreign Application Priority Data

Nov. 22, 2018 (CN) ..... 201821941606.5
Nov. 30, 2018 (CN) ..... 201822012051.2

(51) Int. Cl.
*F04D 29/38* (2006.01)
*F04D 19/00* (2006.01)
(Continued)

(52) U.S. Cl.
CPC ..... *F04D 29/384* (2013.01); *F04D 19/002* (2013.01); *F04D 29/263* (2013.01); *F04D 29/329* (2013.01)

(58) Field of Classification Search
CPC .... F04D 29/384; F04D 19/002; F04D 29/263; F04D 29/329
(Continued)

(56) References Cited

U.S. PATENT DOCUMENTS 4,089,618 A * 5/1978 Patel ..... F01D 5/141 416/228
5,603,607 A * 2/1997 Kondo ..... F04D 29/661 415/119
(Continued)

FOREIGN PATENT DOCUMENTS

CN 102213235 A 10/2011
CN 205101289 U 3/2016
(Continued)

OTHER PUBLICATIONS

The European Patent Office (EPO) Extended Search Report for EP Application No. 19887403.4 dated Feb. 15, 2022 14 Pages.
(Continued)

*Primary Examiner* — Logan M Kraft
*Assistant Examiner* — John D Bailey
(74) *Attorney, Agent, or Firm* — Anova Law Group PLLC

(57) ABSTRACT

An axial-flow impeller includes a hub and blades. A tail edge of one blade has recessed portions successively arranged in a direction from a blade root of the blade to an outer edge of the blade. On a reference projection of the impeller on a reference plane perpendicular to a rotation axis of the impeller, a first connection line connects a starting point of a first recessed portion closest to the blade root and an end
(Continued)

point of a second recessed portion closest to the outer edge, a second connection line connects a tail edge point of the blade root and the end point of the second recessed portion, one or more of the recessed portions is each partially located at a front-edge side of the second connection line, and remaining one or more of the recessed portions is each completely located between the first and second connection lines.

19 Claims, 17 Drawing Sheets

(51) Int. Cl.
*F04D 29/32* (2006.01)
*F04D 29/26* (2006.01)

(58) Field of Classification Search
USPC ..... 416/223 r
See application file for complete search history.

(56) References Cited

U.S. PATENT DOCUMENTS 5,829,956 A * 11/1998 Chen ..... F01D 5/141 416/175
6,779,978 B2 * 8/2004 Camargo Do Amarante ..... F04D 29/384 416/228
7,815,418 B2 * 10/2010 Suzuki ..... F04D 29/667 415/222
8,512,004 B2 * 8/2013 Nakagawa ..... F04D 29/384 415/173.1
8,556,587 B2 * 10/2013 Suzuki ..... B29C 33/44 416/193 R
8,721,280 B2 * 5/2014 Nakagawa ..... F04D 29/164 415/222
8,915,717 B2 * 12/2014 Stephan ..... F04D 29/164 416/243
9,051,941 B2 * 6/2015 Kojima ..... F04D 29/384
9,121,294 B2 * 9/2015 Kray ..... F01D 5/141
9,518,585 B2 * 12/2016 Choi ..... F04D 19/002
9,556,881 B2 * 1/2017 Seiji ..... F04D 29/384
9,605,686 B2 * 3/2017 Hamada ..... F04D 29/386
9,726,190 B2 * 8/2017 Kumon ..... F04D 29/053
10,344,764 B2 * 7/2019 Nakamura ..... F04D 29/002
D884,874 S * 5/2020 Meng ..... F04D 29/384 D23/413
D901,669 S * 11/2020 Bushnell ..... F04D 29/384 D23/413
10,962,275 B2 * 3/2021 Haddad ..... F25B 39/00
11,041,506 B2 * 6/2021 Kim ..... F04D 29/384
11,286,946 B2 * 3/2022 Wang ..... F04D 29/384
2003/0012656 A1 * 1/2003 Cho ..... F04D 29/384 416/235
2004/0091359 A1 * 5/2004 Vanmoor ..... B64C 3/10 416/228
2004/0161338 A1 * 8/2004 Hsieh ..... F04D 25/0613 416/236 A
2004/0253103 A1 * 12/2004 Iwase ..... F04D 29/384 415/220
2007/0031250 A1 * 2/2007 Suzuki ..... F04D 29/667 415/220
2007/0031262 A1 * 2/2007 Kim ..... F04D 29/329 416/243
2007/0177971 A1 * 8/2007 Teraoka ..... F24F 13/24 415/53.1
2011/0200445 A1 * 8/2011 Takeda ..... F04D 29/384 416/223 R
2011/0223024 A1 * 9/2011 Van Houten ..... F04D 29/164 416/223 R
2013/0091888 A1 * 4/2013 Park ..... F04D 29/384 62/426
2014/0271172 A1 * 9/2014 Van Houten ..... F04D 29/681 415/211.1
2014/0314575 A1 * 10/2014 Cho ..... F04D 29/30 416/189
2014/0338388 A1 * 11/2014 Kim ..... F04D 29/681 62/426
2015/0152875 A1 * 6/2015 Kamiya ..... F04D 29/681 416/147
2015/0240645 A1 * 8/2015 Yokose ..... F04D 29/667 416/223 R
2015/0316073 A1 * 11/2015 Lörcher ..... F04D 19/002 425/468
2015/0330223 A1 * 11/2015 Choi ..... F01D 15/005 417/424.2
2016/0281731 A1 * 9/2016 Kim ..... F04D 29/281
2017/0261000 A1 * 9/2017 Komura ..... F04D 29/384
2018/0003190 A1 * 1/2018 Hamada ..... F04D 29/38
2018/0066521 A1 * 3/2018 Sawada ..... F24F 13/24
2018/0080468 A1 * 3/2018 Kim ..... F04D 29/329
2018/0087784 A1 * 3/2018 Sawada ..... F04D 29/181
2018/0306034 A1 * 10/2018 Teramoto ..... F04D 29/384
2018/0355885 A1 * 12/2018 Kim ..... F04D 29/384
2019/0024674 A1 * 1/2019 Loercher ..... F04D 29/384
2019/0226492 A1 * 7/2019 Krishnaswami ..... F04D 29/666
2019/0316599 A1 * 10/2019 Iwata ..... F04D 29/00
2021/0018186 A1 * 1/2021 Bae ..... F24F 1/0018
2021/0285686 A1 * 9/2021 Park ..... F04D 29/281
2021/0340991 A1 * 11/2021 Ojima ..... F04D 29/30
2021/0356145 A1 * 11/2021 Lei ..... F24F 1/0323
2022/0221214 A1 * 7/2022 Tadokoro ..... F04D 29/384

FOREIGN PATENT DOCUMENTS

CN 107178524 A 9/2017
CN 107489646 A 12/2017
CN 207539089 U 6/2018
CN 108843596 A 11/2018
EP 0711925 A1 5/1996
JP 2012026402 A 2/2012
KR 20130020968 A 3/2013

OTHER PUBLICATIONS

World Intellectual Property Organization (WIPO) International Search Report and Written Opinion for PCT/CN2019/084636 with translation dated Jul. 16, 2019 12 Pages.

* cited by examiner

AXIAL-FLOW IMPELLER AND AIR-CONDITIONER HAVING THE SAME

CROSS-REFERENCE TO RELATED APPLICATIONS

The present application is a National Stage Entry under 35 U.S.C. § 371 of International Application No. PCT/CN2019/084636, filed on Apr. 26, 2019, which is based on and claims priority to Chinese Patent Application Nos. 201822012051.2 and 201821941606.5, filed on Nov. 30 and 22, 2018 respectively, the entire contents of all of which are incorporated herein by reference.

FIELD

The present application relates to the technical field of air conditioning equipment, and particularly to an axial-flow impeller and an air-conditioner having the same.

BACKGROUND

In the related art, an axial-flow impeller has a big air outlet noise due to limitation of structures of blades of the axial-flow impeller.

SUMMARY

The present application seeks to solve at least one of the problems existing in the existing technologies. To this end, an object of the present application is to provide an axial-flow impeller that has a low air outlet noise and a light weight.

The present application further provides an air-conditioner with the above-mentioned axial-flow impeller.

The axial-flow impeller according to embodiment of the first aspect of the present application includes: a hub; and a plurality of blades arranged at an outer circumferential wall of the hub at intervals in a circumferential direction of the hub, wherein a tail edge of at least one of the blades is provided with N recessed portions recessed towards a direction of a front edge of the blade, the N recessed portions are successively arranged in a direction from a blade root of the blade to an outer edge of the blade, and are successively first to Nth recessed portions in the direction from the blade root of the blade to the outer edge of the blade, and $N \geq 2$ and is an integer; a projection of the axial-flow impeller on a reference plane is set as a reference projection, the reference plane is a plane perpendicular to a rotation axis of the axial-flow impeller, and on the reference projection, a connection line between a starting point of the first recessed portion and an end point of the Nth recessed portion is a first connection line, and a connection line between a tail edge point of the blade root and the end point of the Nth recessed portion is a second connection line; and M recessed portions are each partially located on the side of the second connection line close to the front edge, (N−M) recessed portions are each completely located between the first connection line and the second connection line, and $M<N$ and is a positive integer.

In the axial-flow impeller according to the embodiments of the present application, the plural recessed portions recessed towards the front edge are arranged at the tail edge of the at least one blade, and on the reference projection, part of the recessed portions are located on the side of the above-mentioned second connection line close to the front edge, and the other part of the recessed portions are located between the first connection line and the second connection line, such that on the one hand, a time difference may be formed in outlet airflow of the axial-flow impeller, thereby dispersing a frequency of the outlet airflow to reduce the air outlet noise; and on the other hand, a weight of the axial-flow impeller may be reduced, thus reducing a motor load and power.

According to some embodiments of the present application, on the reference projection, a part of the Nth recessed portion is located on the side of the second connection line close to the front edge.

Optionally, on the reference projection, the point on a contour line of the Nth recessed portion furthest from the second connection line is located on the side of the second connection line close to the front edge.

According to some embodiments of the present application, on the reference projection, the first recessed portion is located between the first connection line and the second connection line.

According to some embodiments of the present application, a projection of the recessed portion on the reference plane is a curve, and the recessed portion is smoothly and transitionally connected with the part of the tail edge other than the recessed portion.

Optionally, on the reference projection, the part of the tail edge located between two adjacent recessed portions is a straight line.

According to some embodiments of the present application, at least one of the blades has a thinned region spaced apart from both the front edge and the outer edge of the blade, and the thinned region has a thickness less than a thickness of other regions of the blade other than the thinned region.

According to some embodiments of the present application, a thickened portion is provided at the part of the blade root of the blade close to the front edge of the blade.

Optionally, the thickened portion is provided at a pressure surface of the blade.

Optionally, in a direction from the hub to the outer edge of the blade, the thickened portion has a thickness reduced gradually, and the thickness of the thickened portion refers to a size of the thickened portion in a thickness direction of the blade.

Optionally, in the direction from the hub to the outer edge of the blade, the thickened portion has a width reduced gradually, and the width of the thickened portion refers to a size of the thickened portion in the circumferential direction of the hub.

Optionally, the thickened portion has a thickness with a maximum value ranging from 1 mm to 10 mm, and the thickness of the thickened portion refers to the size of the thickened portion in the thickness direction of the blade.

Optionally, the thickened portion has a width with a maximum value ranging from 5 mm to 30 mm, and the width of the thickened portion refers to the size of the thickened portion in the circumferential direction of the hub.

Optionally, the thickened portion has a length with a maximum value ranging from 10 mm to 50 mm, and the length of the thickened portion refers to a size of the thickened portion in the direction from the hub to the outer edge of the blade.

According to some embodiments of the present application, in airflow incoming direction, the hub has a closed front end surface and an open rear end surface, a hub cavity with an open rear end is formed in the hub, and the front end surface is provided with a fitting groove suitable for being fitted with a motor.

According to some embodiments of the present application, a hub boss is provided in the hub cavity and has an outer circumferential wall spaced apart from an inner circumferential wall of the hub cavity, and a shaft hole suitable for being fitted with an output shaft of the motor is formed in the hub boss and communicated with the fitting groove.

According to some optional embodiments of the present application, a plurality of reinforcing rib plates are arranged between the inner circumferential wall of the hub cavity and the outer circumferential wall of the hub boss at intervals in a circumferential direction of the hub boss.

Optionally, the number of the reinforcing rib plates is 3-6.

Optionally, each reinforcing rib plate is connected with the outer circumferential wall of the hub boss, the inner circumferential wall of the hub cavity, and a front end wall of the hub cavity.

According to some optional embodiments of the present application, in a direction from the front end surface to the rear end surface of the hub, the outer circumferential wall of the hub boss extends obliquely in a direction close to a central axis of the hub.

According to some embodiments of the present application, a plurality of stacking bosses are formed at the front end surface of the hub, arranged at intervals in the circumferential direction of the hub and located on an outer circumferential side of the fitting groove; and when the axial-flow impellers are stacked axially, the stacking boss of one of two adjacent axial-flow impellers is adapted to extend into the hub cavity of the other axial-flow impeller and be fitted with the inner circumferential wall of the hub cavity.

Optionally, each stacking boss extends in the circumferential direction of the hub.

Optionally, the hub boss is provided in the hub cavity and has the outer circumferential wall spaced apart from the inner circumferential wall of the hub cavity, the shaft hole suitable for being fitted with the output shaft of the motor is formed in the hub boss and communicated with the fitting groove, the plural reinforcing rib plates are arranged between the inner circumferential wall of the hub cavity and the outer circumferential wall of the hub boss at intervals in the circumferential direction of the hub boss, a rear end surface of each reinforcing rib plate is located on a front side of the rear end surface of the hub, a rear end surface of each reinforcing rib plate and the rear end surface of the hub have a distance d, each stacking boss has a thickness h in a front-rear direction, and $d \geq h$.

The air-conditioner according to embodiments of the second aspect of the present application includes the axial-flow impeller according to the embodiments of the first aspect of the present application.

In the air-conditioner according to the embodiments of the present application, the arrangement of the above-mentioned axial-flow impeller may reduce the air outlet noise and power.

Additional aspects and advantages of the present application will be given in part in the following descriptions, become apparent in part from the following descriptions, or be learned from the practice of the embodiments of the present application.

BRIEF DESCRIPTION OF THE DRAWINGS

The above and/or additional aspects and advantages of the present application will become apparent and more readily appreciated from the following descriptions made with reference to the drawings, in which.

REFERENCE NUMERALS

Figure 1:
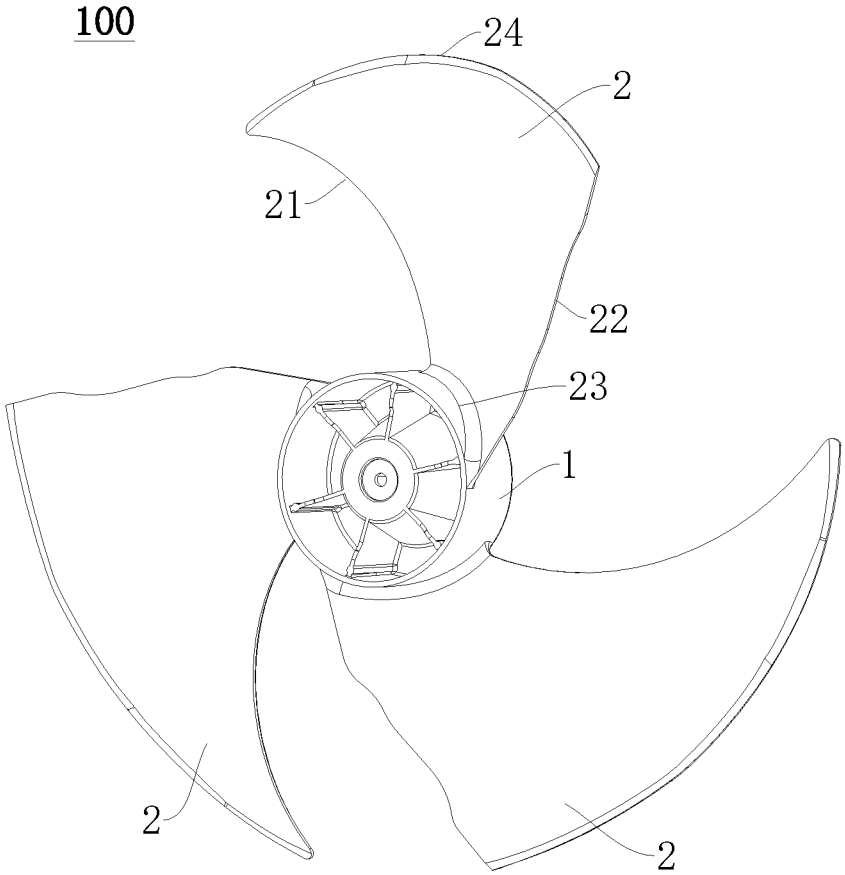
FIG. 1 is a perspective view of an axial-flow impeller according to one embodiment of the present application.

Axial-flow impeller 100;

hub 1; hub cavity 11; fitting groove 12; stacking boss 13; hub boss 14; shaft hole 141; reinforcing rib plate 15; blade 2; front edge 21; thickened portion 211; tail edge 22; recessed portion 221; blade root 23; outer edge 24; thinned region 25; first connection line s1; second connection line s2.

DETAILED DESCRIPTION

Reference will be made in detail to embodiments of the present application, and the examples of the embodiments are illustrated in the drawings, wherein the same or similar elements and the elements having same or similar functions are denoted by like reference numerals throughout the descriptions. The embodiments described herein with reference to drawings are illustrative, and merely used to explain the present application. The embodiments shall not be construed to limit the present application.

An axial-flow impeller 100 according to the embodiments of the present application will be described below with reference to FIGS. 1 to 16.

Figure 2:
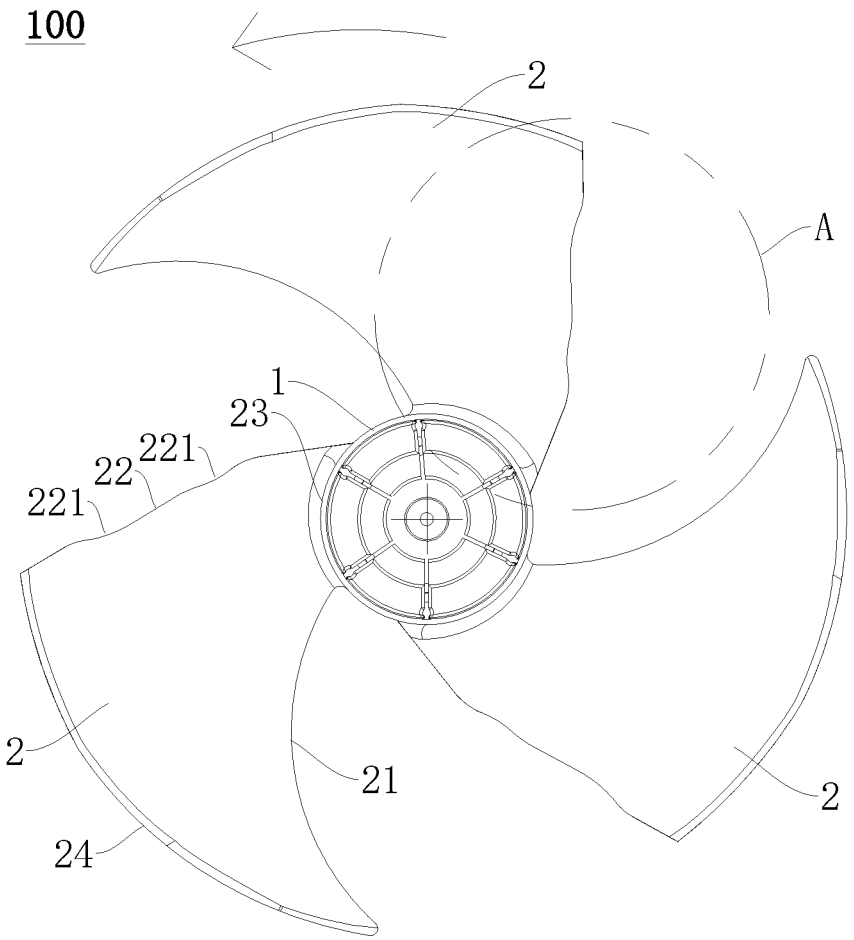
FIG. 2 is a front view of the axial-flow impeller of FIG. 1.
Figure 11:
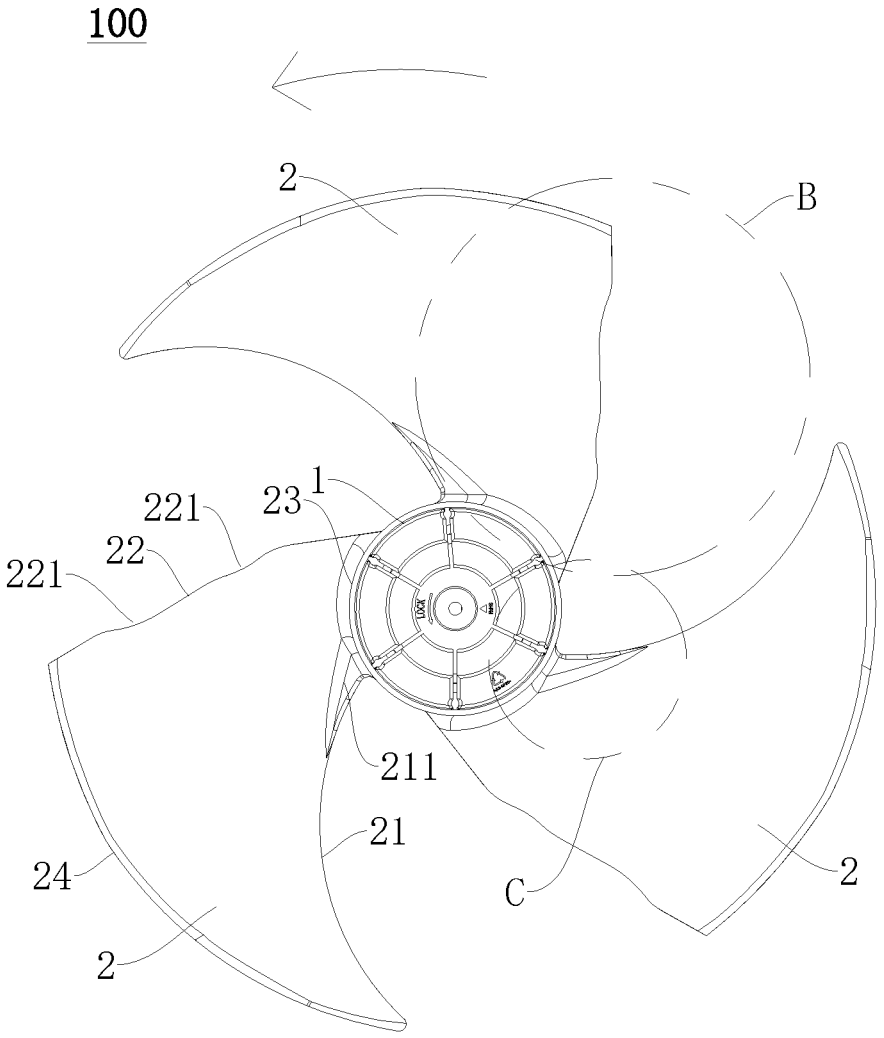
FIG. 11 is a front view of the axial-flow impeller of FIG. 10.

Referring to FIGS. 1 to 16 (the direction of the arrow in FIGS. 2 and 11 is a rotation direction of the axial-flow impeller 100), the axial-flow impeller 100 according to the embodiment of the first aspect of the present application includes a hub 1 and a plurality of blades 2.

Specifically, the plural blades 2 are arranged at an outer circumferential wall of the hub 1 at intervals in a circumferential direction of the hub 1, and thus rotate to form airflow when the axial-flow impeller 100 rotates. Optionally, the number of the blades 2 may be 2-7, for example, 3.

A tail edge 22 of at least one blade 2 is provided with N recessed portions 221 recessed in a direction of a front edge 21 of the blade 2, the N recessed portions 221 are successively arranged in a direction from a blade root 23 of the blade 2 to an outer edge 24 of the blade 2, and N≥2 and is an integer. For example, the above-mentioned N recessed portions 221 may be provided at the tail edge 22 of only one blade 2 or the tail edges of part of the blades 2, or the tail edge 22 of each blade 2 is provided with the above-mentioned N recessed portions 221. Thus, the blade 2 with the above-mentioned N recessed portions 221 has inconsistent air outlet time at the tail edge, the outlet airflow of the axial-flow impeller 100 has a time difference, and air outlet frequencies are different, thereby dispersing a frequency of the outlet airflow to form a broadband aerodynamic noise and reducing the air outlet noise; and a weight of the axial-flow impeller 100 may be reduced, thus reducing a motor load and power.

Further, in the direction from the blade root 23 of the blade 2 to the outer edge 24 of the blade 2, the N recessed portions 221 are successively first to Nth recessed portions 221, a projection of the axial-flow impeller 100 on a reference plane is set as a reference projection, and the reference plane is a plane perpendicular to a rotation axis of the axial-flow impeller 100. On the reference projection, a connection line between a starting point of the first recessed portion 221 and an end point of the Nth recessed portion 221 is a first connection line s1, and a connection line between a tail edge 22 point of the blade root 23 and the end point of the Nth recessed portion 221 is a second connection line s2; and M recessed portions 221 are each partially located on the side of the second connection line s2 close to the front edge 21, (N−M) recessed portions 221 are each completely located between the first connection lines s1 and the second connection line s2, and M<N and is a positive integer. Thus, on the reference projection, part of the recessed portions 221 are each partially located on the side of the above-mentioned second connection line s2 close to the front edge 21, and the other part of the recessed portions 221 are each located between the first connection line s1 and the second connection line s2, such that at least part of the recessed portions 221 have different depths to further disperse the frequency of the outlet airflow, thus better reducing the air outlet noise.

For example, N=2, and M=1; or, N=3, and M=1; or, N=3, and M=2.

The depth of the recessed portion 221 refers to a maximum distance between a contour line of the recessed portion 221 and the first connection line s1 on the reference projection.

It should be noted that the starting point and the end point of the above-mentioned recessed portion 221 are relative to the direction from the blade root 23 of the blade 2 to the outer edge 24 of the blade 2. On the reference projection, each recessed portion 221 has two ends in the direction from the blade root 23 of the blade 2 to the outer edge 24 of the blade 2, with the end proximal to the blade root 23 as the starting point and the end proximal to the outer edge 24 as the end point.

In the axial-flow impeller 100 according to the embodiments of the present application, the plural recessed portions 221 recessed towards the front edge 21 are arranged at the tail edge 22 of the at least one blade 2, and on the reference projection, part of the recessed portions 221 are each partially located on the side of the above-mentioned second connection line s2 close to the front edge 21, and the other part of the recessed portions 221 are each located between the first connection line s1 and the second connection line s2, such that on the one hand, the time difference may be formed in the outlet airflow of the axial-flow impeller 100, thereby dispersing the frequency of the outlet airflow to reduce the air outlet noise; and on the other hand, the weight of the axial-flow impeller 100 may be reduced, thus reducing the motor load and power.

According to some embodiments of the present application, referring to FIGS. 2, 3, 11 and 12, on the reference projection, the Nth recessed portion 221 is partially located on the side of the second connection line s2 close to the front edge 21 of the corresponding blade 2. Thus, by partially locating the Nth recessed portion 221 on the side of the second connection line s2 close to the front edge 21, the recessed portion 221 closest to the outer edge 24 may have a greater depth, so as to achieve an effect of better dispersing the airflow frequency, thereby further reducing the air outlet noise.

Figure 3:
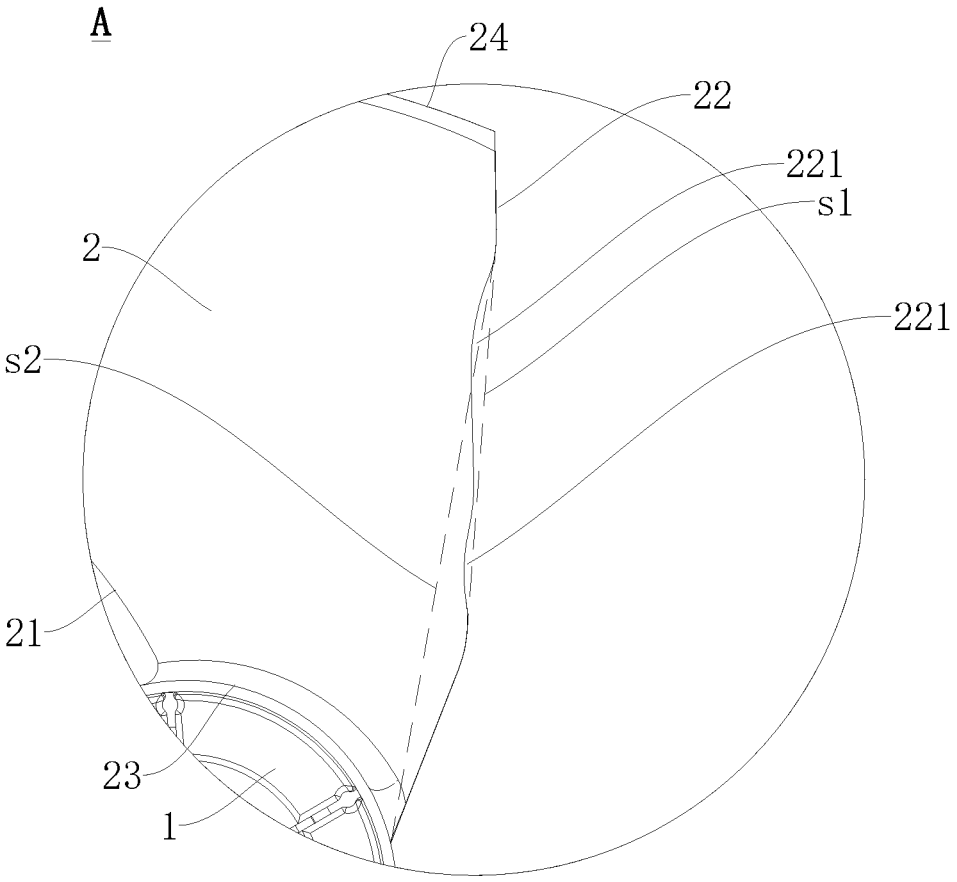
FIG. 3 is an enlarged view at A in FIG. 2.
Figure 4:
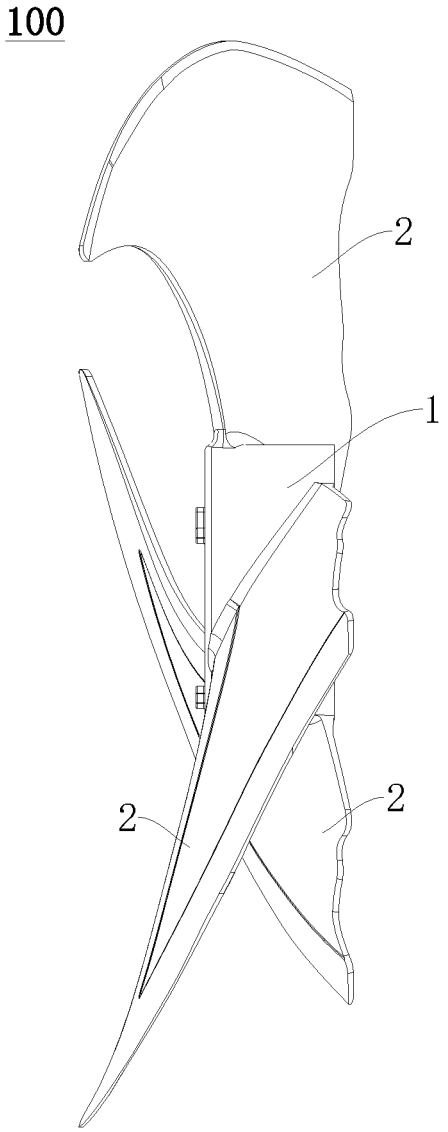
FIG. 4 is a side view of the axial-flow impeller of FIG. 1.
Figure 12:
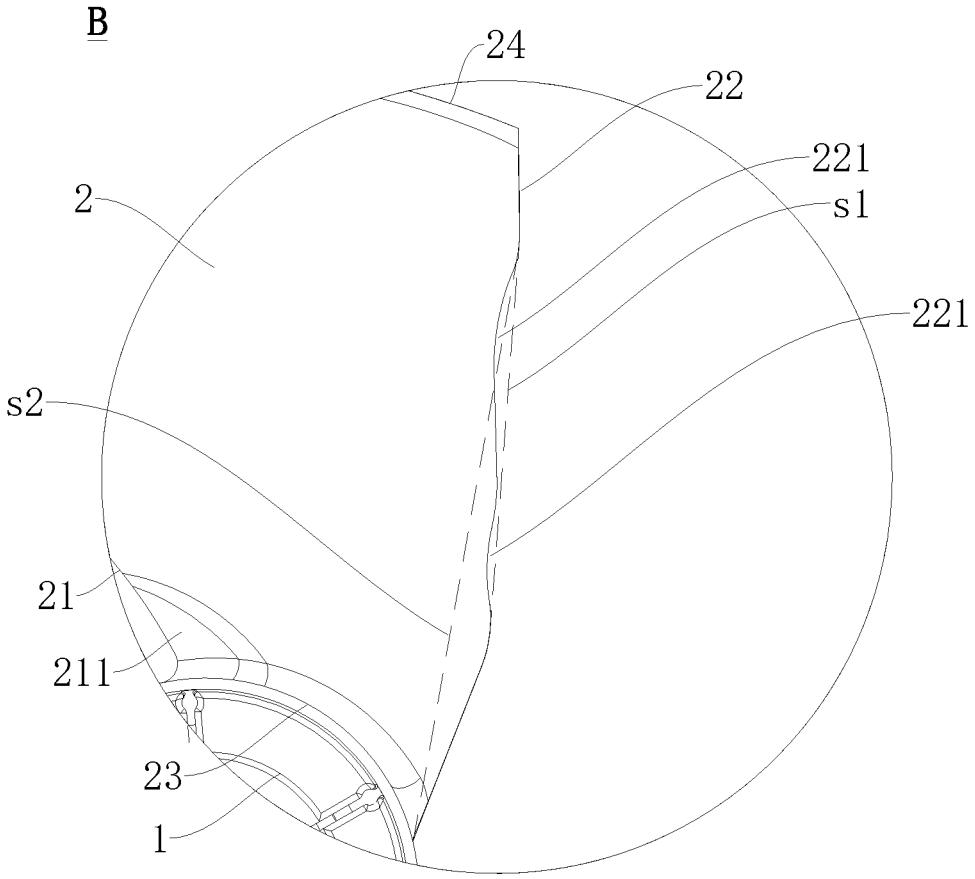
FIG. 12 is an enlarged view at B in FIG. 11.

Optionally, referring to FIGS. 3 and 12, on the reference projection, the point on the contour line of the Nth recessed portion 221 furthest from the second connection line s2 is located on the side of the second connection line s2 close to the front edge 21 of the corresponding blade 2, so as to achieve the effect of better dispersing the airflow frequency, thereby further reducing the air outlet noise.

According to some embodiments of the present application, referring to FIGS. 3 and 12, on the reference projection, the first recessed portion 221 is located between the first connection line s1 and the second connection line s2. Thus, by locating the first recessed portion 221 between the first connection line s1 and the second connection line s2, the recessed portion 221 closest to the blade root 23 may have a less depth, so as to achieve the effect of better dispersing the airflow frequency, thereby better reducing the air outlet noise.

According to some embodiments of the present application, a projection of the recessed portion 221 on the reference plane is a curve, and the recessed portion 221 is smoothly and transitionally connected with the part of the tail edge 22 of the blade 2 other than the recessed portion 221, thus further reducing the noise, and facilitating an injection molding process of the blade 2 when the blade 2 is a plastic part.

Optionally, on the reference projection, the part of the tail edge 22 of the blade 2 located between two adjacent recessed portions 221 is a straight line. Thus, the blade 2 has a simple structure and is convenient to manufacture.

In other embodiments, on the reference projection, the part of the tail edge 22 of the blade 2 located between two adjacent recessed portions 221 may be a curve.

For example, in the examples of FIGS. 1 to 12, the axial-flow impeller 100 includes three blades 2, the tail edge 22 of each blade 2 has two recessed portions 221, and the two recessed portions 221 are arranged at intervals in the direction from the blade root 23 to the outer edge 24. The first recessed portion 221 is located between the first connection line s1 and the second connection line s2. On the reference projection, the point of the contour line of the second recessed portion 221 furthest from the second connection line s2 is located on the side of the second connection line s2 close to the front edge 21, the projection of each recessed portion 221 on the reference plane is a curve, and the recessed portion 221 is smoothly and transitionally connected with the part of the tail edge 22 of the blade 2 other than the recessed portion 221. On the reference projection, the part of the tail edge 22 of the blade 2 located between two adjacent recessed portions 221 is a straight line.

Figure 5:
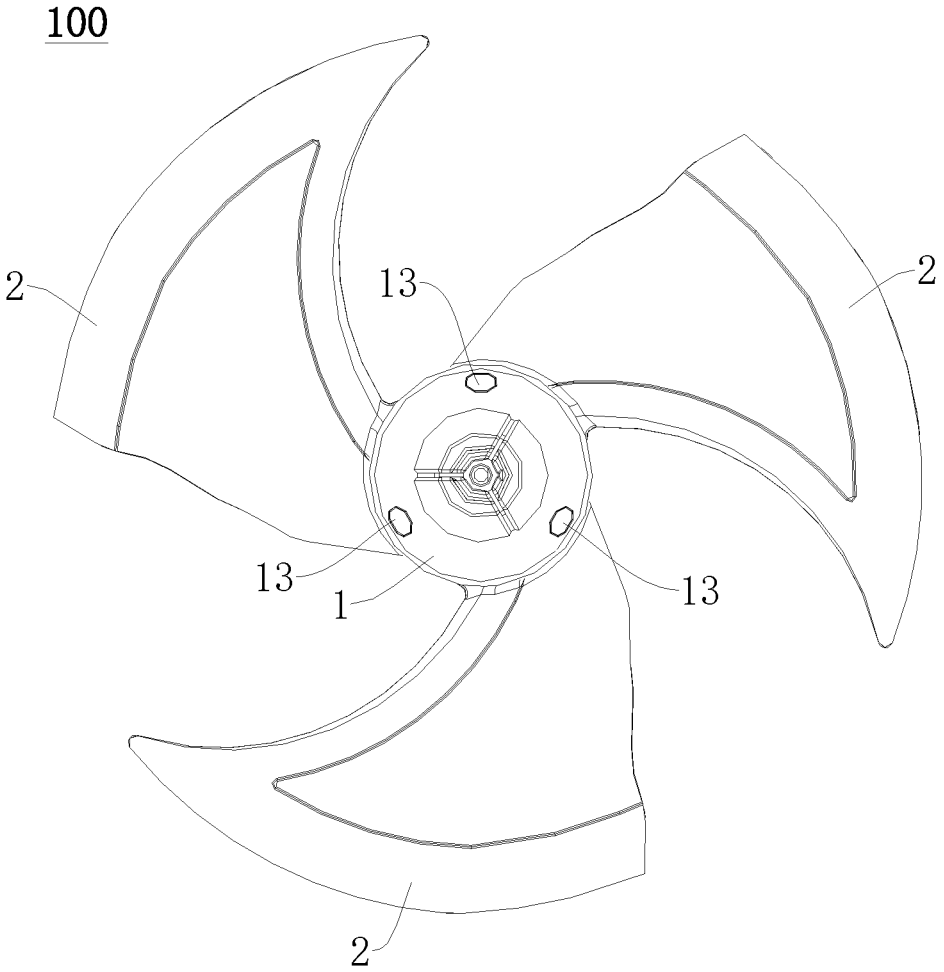
FIG. 5 is a rear view of the axial-flow impeller of FIG. 1.
Figure 16:
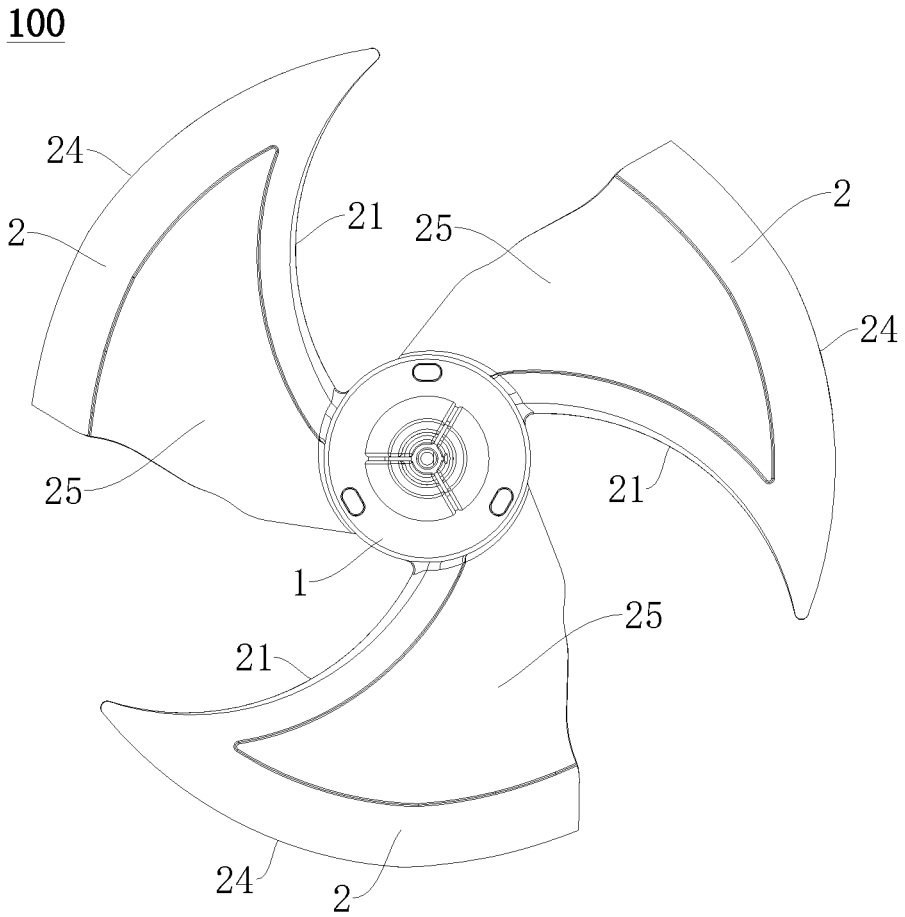
FIG. 16 is a rear view of the axial-flow impeller of FIG. 10.

According to some embodiments of the present application, referring to FIGS. 5 and 16, at least one blade 2 has a thinned region 25, for example, only one blade 2 has the thinned region 25, or each blade 2 has the thinned region 25. The thinned region 25 is spaced apart from both the front edge 21 and the outer edge 24 of the blade 2, and has a thickness less than a thickness of other regions of the blade 2 other than the thinned region 25. Thus, under the condition that the blade 2 has certain size and specification, a weight of the single blade 2 may be reduced, and under the condition that the axial-flow impeller 100 has certain size and specification, the whole weight of the axial-flow impeller 100 may be obviously reduced, thereby further reducing the motor load and then further reducing the power.

Optionally, with reference to FIGS. 5 and 16, a groove is formed in a suction surface of the blade 2 and spaced apart from both the front edge 21 and the outer edge 24 of the blade 2, and meanwhile may extend to the tail edge 22 of the blade 2, and the portion of the blade 2 in which the above-mentioned groove is formed constitutes the thinned region 25. Thus, under the condition that the axial-flow impeller 100 has the certain size and specification, the whole weight of the axial-flow impeller 100 may be obviously reduced; and the above-mentioned groove is formed in the suction surface of the blade 2, thus guaranteeing beauty of a front surface of the axial-flow impeller 100.

According to some embodiments of the present application, referring to FIGS. 11, and 13 to 15, a thickened portion 211 is provided at the part of the blade root 23 of the blade 2 close to the front edge 21 of the blade 2, thus improving structural strength of the blade 2 and reducing deformation of the impeller during operation. Optionally, the above-mentioned thickened portion 211 may be provided on a pressure surface or the suction surface of the blade 2.

Figure 15:
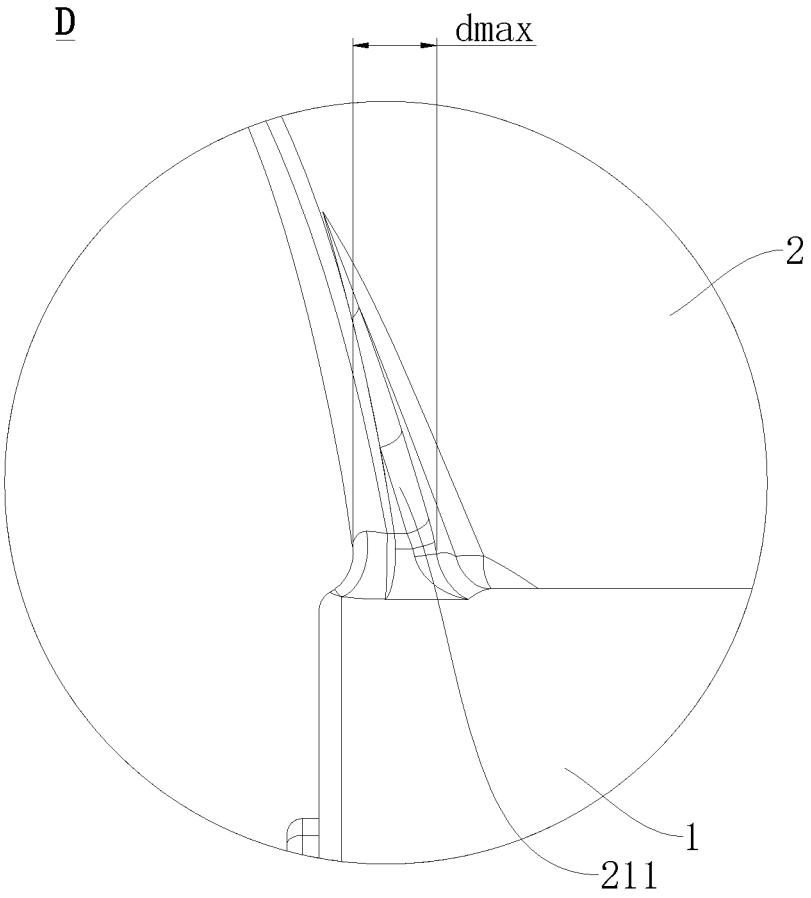
FIG. 15 is an enlarged view at Din FIG. 14.

Optionally, referring to FIG. 15, in a direction from the hub 1 to the outer edge 24 of the blade 2, the thickened portion 211 has a thickness reduced gradually, and the thickness of the thickened portion 211 refers to a size of the thickened portion 211 in a thickness direction of the blade 2. Thus, the thickened portion 211 may be smoothly connected with the pressure surface or the suction surface of the blade 2 while the structural strength of the axial-flow impeller 100 is improved, which avoids air flow turbulence caused by an overlarge step.

Optionally, in the direction from the hub 1 to the outer edge 24 of the blade 2, the thickened portion 211 has a width reduced gradually, and the width of the thickened portion 211 refers to a size of the thickened portion 211 in a circumferential direction of the hub 2. Thus, the thickened portion 211 may be smoothly connected with the pressure surface or the suction surface of the blade 2 while the structural strength of the axial-flow impeller 100 is improved, which avoids the air flow turbulence caused by an overlarge step.

Optionally, referring to FIG. 15, the thickened portion 211 has a thickness with a maximum value dmax ranging from 1 mm to 10 mm, and the thickness of the thickened portion 211 refers to the size of the thickened portion 211 in the thickness direction of the blade 2. Thus, the weight of the axial-flow impeller 100 may be kept in a small range while the structural strength of the axial-flow impeller 100 may be improved. For example, the maximum value dmax of the thickness of the thickened portion 211 may range from 2 mm to 5 mm.

Figure 13:
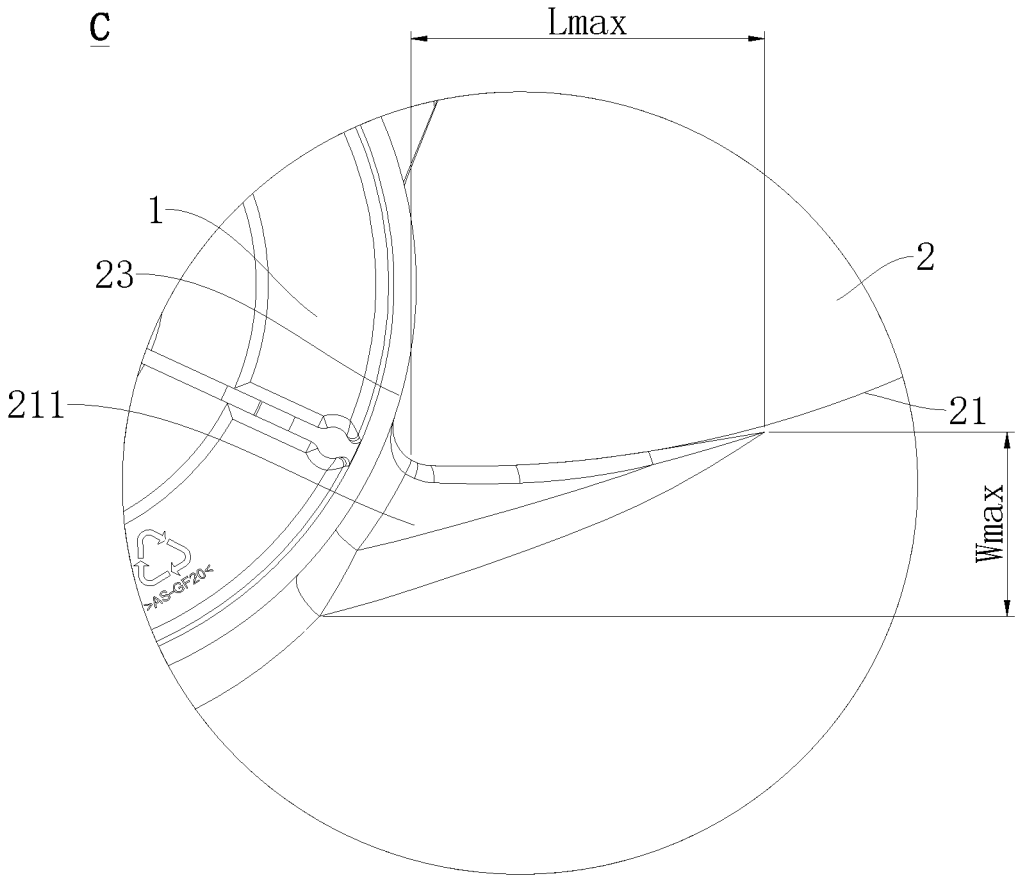
FIG. 13 is an enlarged view at C in FIG. 11.
Figure 14:
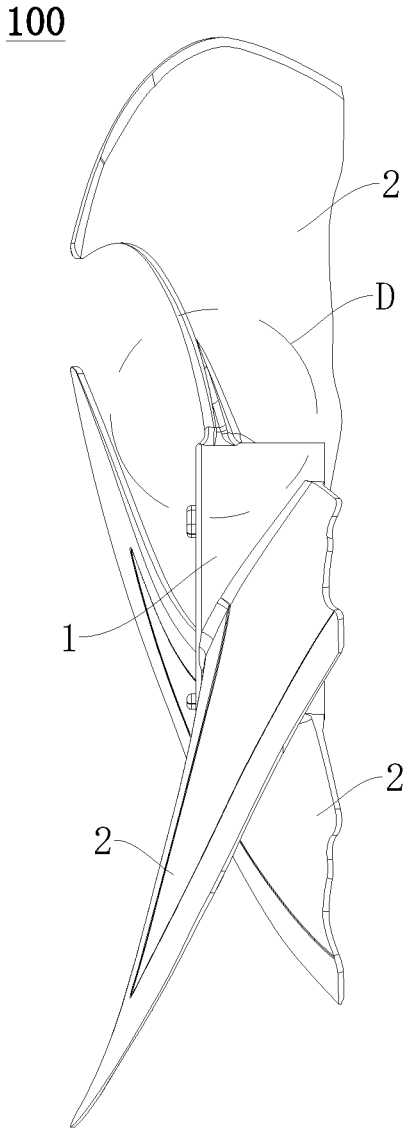
FIG. 14 is a side view of the axial-flow impeller of FIG. 10.

Optionally, referring to FIG. 13, the thickened portion 211 has a width with a maximum value ranging from 5 mm to 30 mm, and the width of the thickened portion 211 refers to the size of the thickened portion 211 in the circumferential direction of the hub 1. Thus, the weight of the axial-flow impeller 100 may be kept in a small range while the structural strength of the axial-flow impeller 100 may be improved. For example, the maximum value Wmax of the width of the thickened portion 211 ranges from 10 mm to 20 mm.

Optionally, referring to FIG. 13, the thickened portion 211 has a length with a maximum value Lmax ranging from 10 mm to 50 mm, and the length of the thickened portion 211 refers to a size of the thickened portion 211 in the direction from the hub 1 to the outer edge 24 of the blade 2. Thus, the weight of the axial-flow impeller 100 may be kept in a small range while the structural strength of the axial-flow impeller 100 may be improved. For example, the maximum value Lmax of the length of the thickened portion 211 ranges from 20 mm to 40 mm.

For example, in the examples of FIGS. 11, and 13 to 15, the axial-flow impeller 100 includes three blades 2, and the thickened portion 211 is provided at the part of the blade root 23 of each blade 2 close to the front edge 21 of the blade 2, and located on the pressure surface of the blade 2. The thickness and width of the thickened portion 211 are gradually reduced in the direction from the hub 1 to the outer edge 24 of the blade 2. Thus, the thickened portion 211 may be better connected with the pressure surface or the suction surface of the blade 2 smoothly while the structural strength of the axial-flow impeller 100 is improved, which avoids the air flow turbulence caused by an overlarge step.

Figure 17:
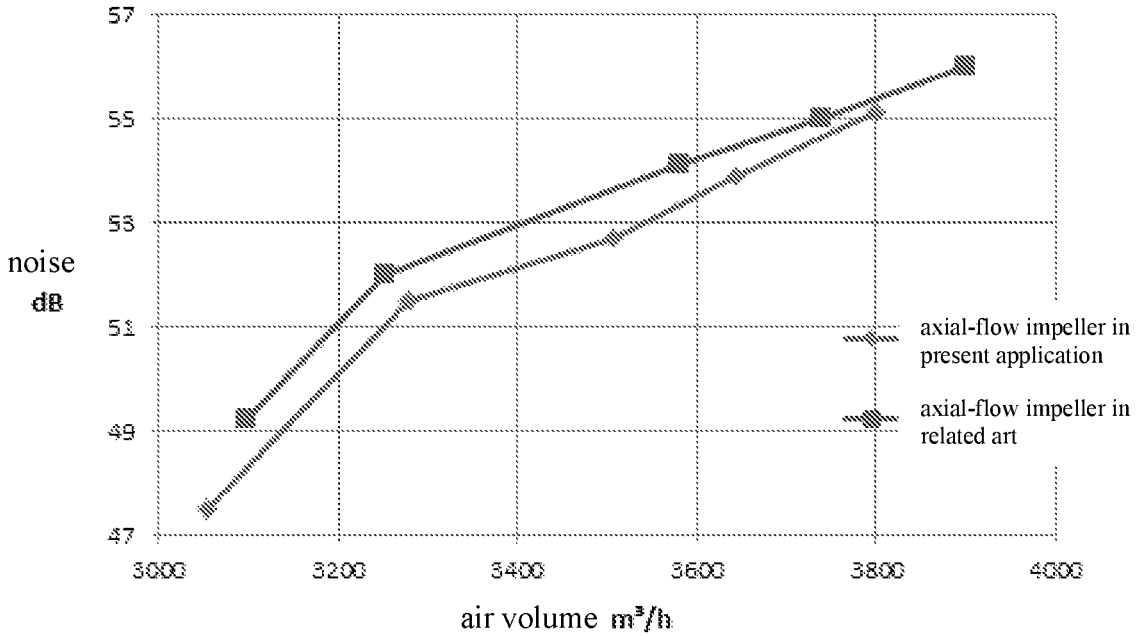
FIG. 17 is a graph showing comparison between an air volume-noise curve of the axial-flow impeller according to the embodiment of the present application and an air volume-noise curve of an axial-flow impeller in the related art.
Figure 18:
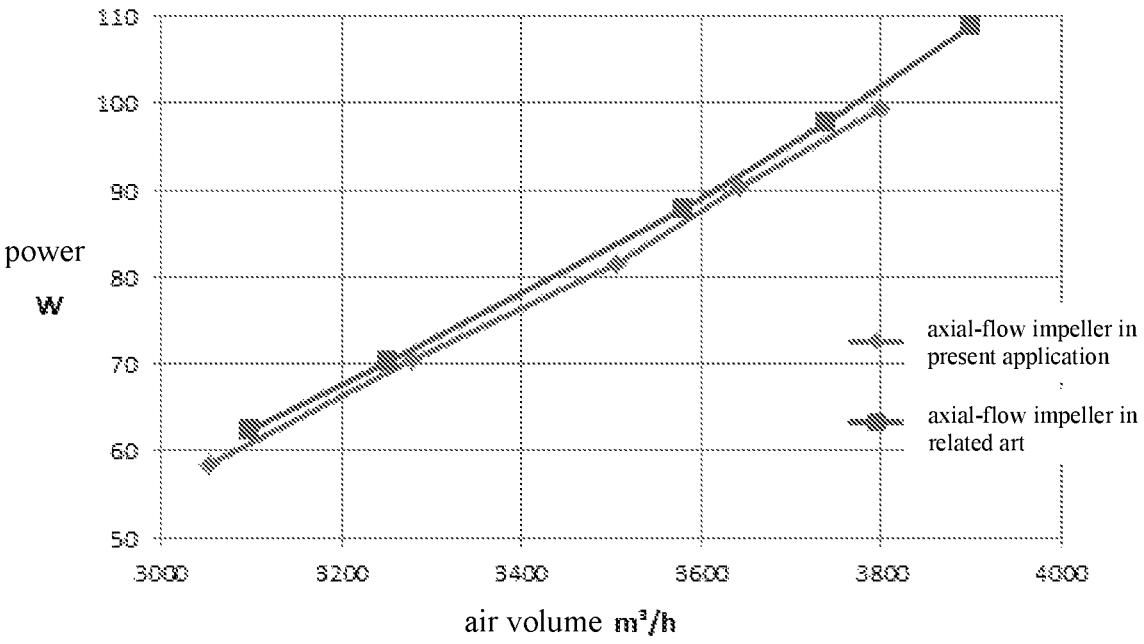
FIG. 18 is a graph showing comparison between an air volume-power curve of the axial-flow impeller according to the embodiment of the present application and an air volume-power curve of the axial-flow impeller in the related art.

Referring to FIGS. 17 and 18 in conjunction with FIGS. 1 to 16, in practical research, the inventors applied the axial-flow impeller 100 to an air-conditioner, and by conducting experiments by placing the axial-flow impeller 100 according to the present application and an axial-flow impeller in the related art in the same air-conditioner prototype, obtained an air volume-noise graph as shown in FIG. 17 and an air volume-power graph as shown in FIG. 18. The axial-flow impeller 100 according to the present application has three blades 2, and the tail edge 22 of each blade 2 has two recessed portions 221, with the first recessed portion 221 located between the first connection line s1 and the second connection line s2. On the reference projection, the point of the contour line of the second recessed portion 221 furthest from the second connection line s2 is located on the side of the second connection line s2 close to the front edge 21, and the projection of each recessed portion 221 on the reference plane is a curve.

As can be seen from the curve of FIG. 17, the axial-flow impeller 100 according to the present application has a small noise value under the same air volume.

As can be seen from the curve of FIG. 18, the axial-flow impeller 100 according to the present application has small power under the same air volume.

According to some embodiments of the present disclosure, referring to FIGS. 6 to 9, in airflow incoming direction (referring to direction e in FIG. 8), the hub 1 has a closed front end surface and an open rear end surface, a hub cavity 11 with an open rear end is formed in the hub 1, and the front end surface is provided with a fitting groove 12 suitable for being fitted with a motor. When the axial-flow impeller 100 is connected with the motor, a part of the motor is adapted to be fitted with the fitting groove 12, such that the motor is reliably connected with the axial-flow impeller 100.

When the axial-flow impeller 100 rotates and the airflow flows through the hub 1, since the front end surface of the hub 1 is closed, the airflow may flow to an outer side of the hub 1 along the front end surface, and vortex at a front end of the hub 1 may be reduced or avoided, thereby reducing airflow loss, an airflow turbulence degree, wind resistance, and the noise.

Figure 6:
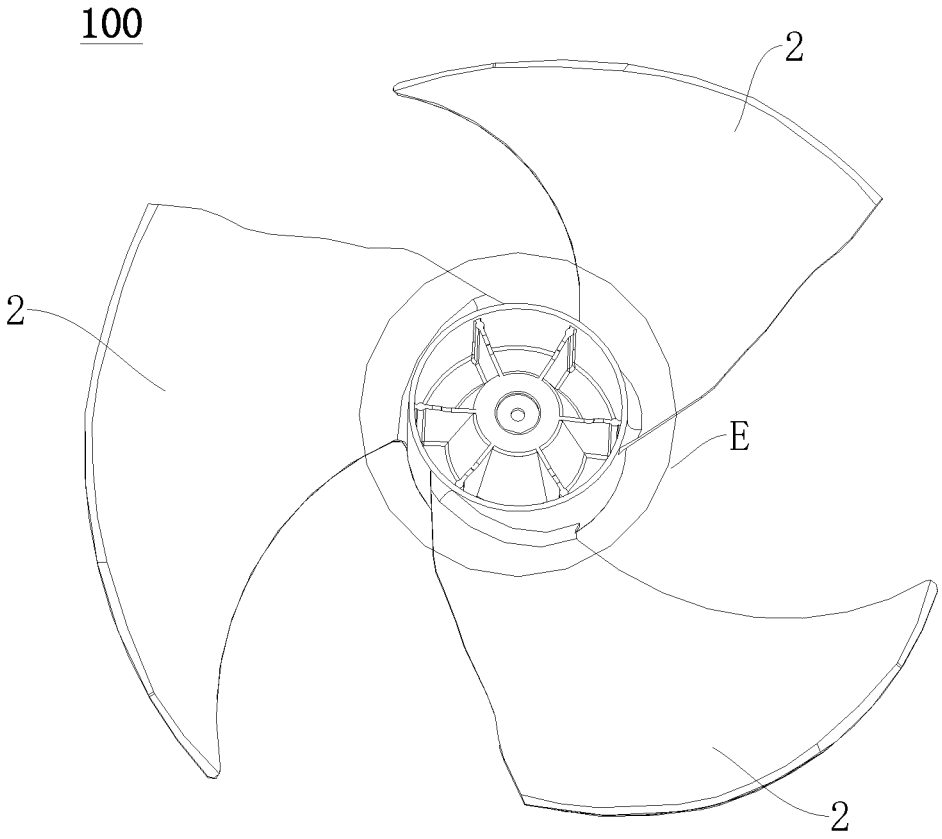
FIG. 6 is a perspective view of the axial-flow impeller of FIG. 1 from another perspective.
Figure 7:
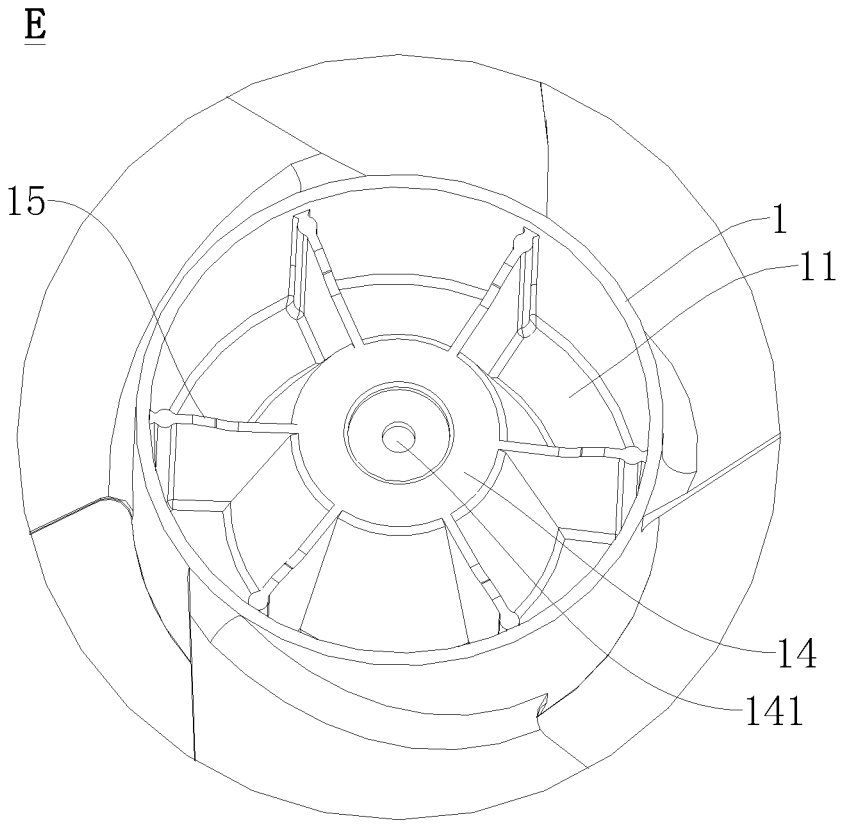
FIG. 7 is an enlarged view at E in FIG. 6.
Figure 8:
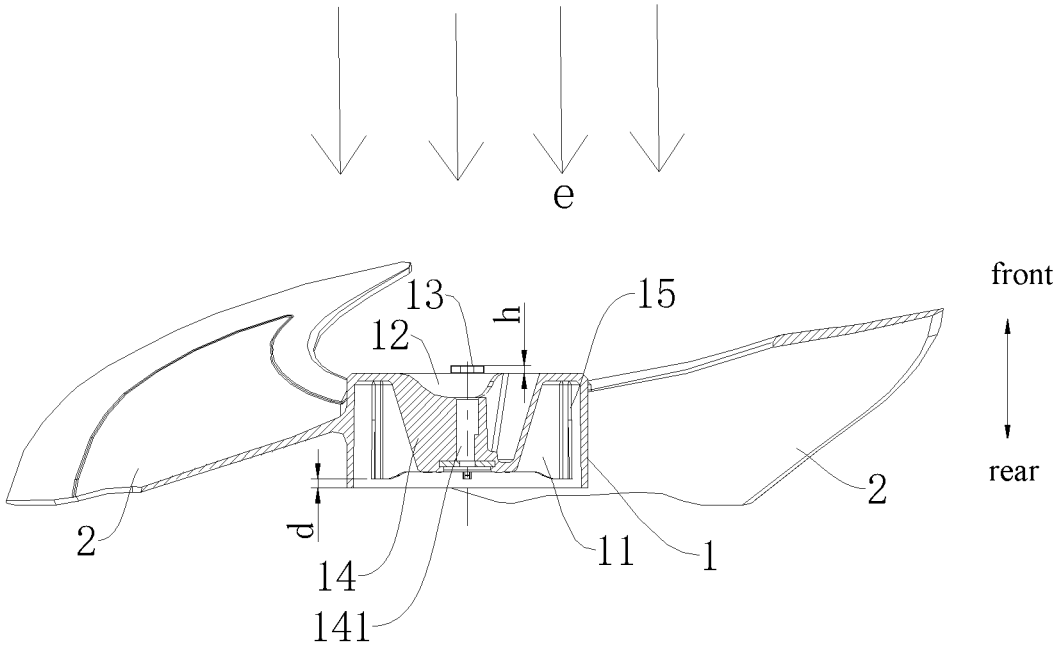
FIG. 8 is a sectional view of the axial-flow impeller of FIG. 6.
Figure 19:
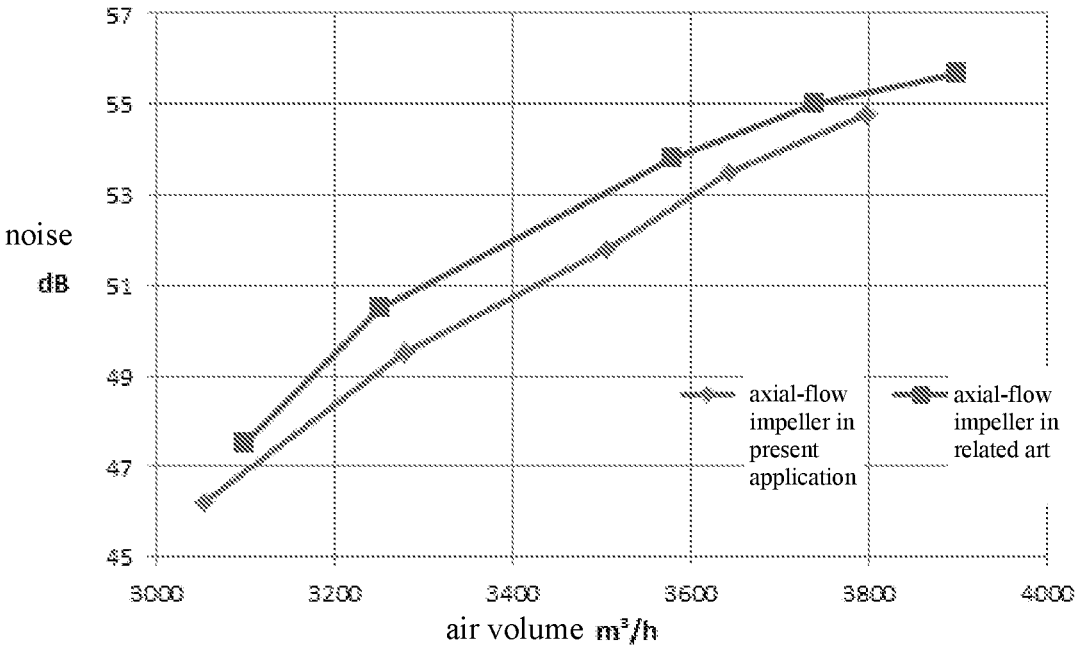
FIG. 19 is another graph showing comparison between the air volume-noise curve of the axial-flow impeller according to the embodiment of the present application and the air volume-noise curve of the axial-flow impeller in the related art.

Referring to FIG. 19 in conjunction with FIGS. 6 to 8, in practical research, the inventors arranged the front end surface of the hub 1 of the axial-flow impeller 100 according to the present application to be closed and the rear end surface to be open, applied the axial-flow impeller 100 to the air-conditioner, and by conducting experiments by placing the axial-flow impeller 100 according to the present application and the axial-flow impeller in the related art in the same air-conditioner prototype, obtained an air volume-noise graph as shown in FIG. 19. As can be seen from the curve of FIG. 19, the axial-flow impeller 100 according to the present application has a small noise value under the same air volume.

According to some embodiments of the present application, referring to FIGS. 1 to 9, a hub boss 14 is provided in the hub cavity 11 and has an outer circumferential wall spaced apart from an inner circumferential wall of the hub cavity 11, and a shaft hole 141 suitable for being fitted with an output shaft of the motor is formed in the hub boss 14 and communicated with the fitting groove 12. Thus, when the motor is connected with the axial-flow impeller 100, the output shaft of the motor passes through the above-mentioned fitting groove 12 and extends into the shaft hole 141. The arranged hub boss 14 facilitates the connection between the output shaft of the motor and the hub 1, and may guarantee the structural strength of the hub 1.

According to some optional embodiments of the present application, referring to FIGS. 1 to 8, a plurality of reinforcing rib plates 15 are arranged between the inner circumferential wall of the hub cavity 11 and the outer circumferential wall of the hub boss 14 at intervals in a circumferential direction of the hub boss 14. Thus, the structural strength of the hub 1 may be improved by providing the plurality of reinforcing rib plates 15 between the inner circumferential wall of the hub cavity 11 and the outer circumferential wall of the hub boss 14.

Optionally, the number of the reinforcing rib plates 15 is 3-6. Thus, the hub 1 may have high structural strength and a simple structure and is easy to mold. For example, in the examples of FIGS. 1 to 7, the number of the reinforcing rib plates 15 is six, and the six reinforcing rib plates 15 are arranged at regular intervals in the circumferential direction of the hub boss 14.

Optionally, each reinforcing rib plate 15 is connected with the outer circumferential wall of the hub boss 14, the inner circumferential wall of the hub cavity 11, and a front end wall of the hub cavity 11, thus further improving the structural strength of the whole hub 1.

According to some optional embodiments of the present application, referring to FIGS. 1 to 8, in a direction from the front end surface to the rear end surface of the hub 1, the outer circumferential wall of the hub boss 14 extends obliquely in a direction close to a central axis of the hub 1. Thus, by providing the outer circumferential wall of the hub boss 14 to extend obliquely, a mold drawing operation of the hub 1 may be more convenient when the hub 1 is subjected to an injection molding or cast molding operation. Optionally, the hub boss 14 has a trapezoidal longitudinal section. The longitudinal section of the hub boss 14 is a plane figure obtained by cutting the hub boss 14 through a plane of a central axis of the hub boss 14.

Figure 9:
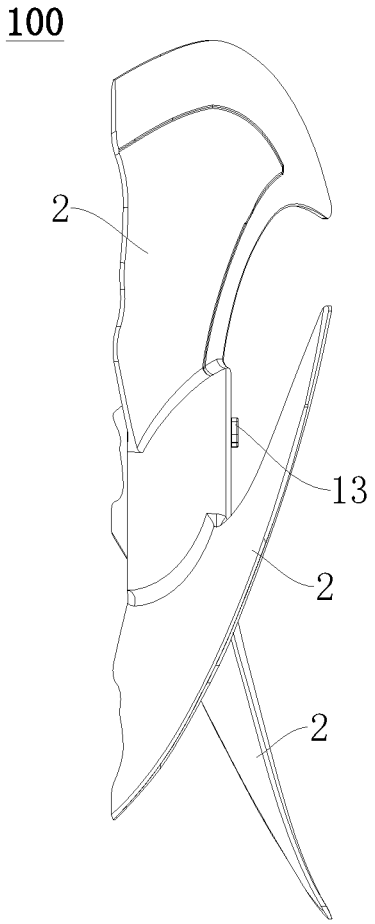
FIG. 9 is a side view of the axial-flow impeller of FIG. 6.
Figure 10:
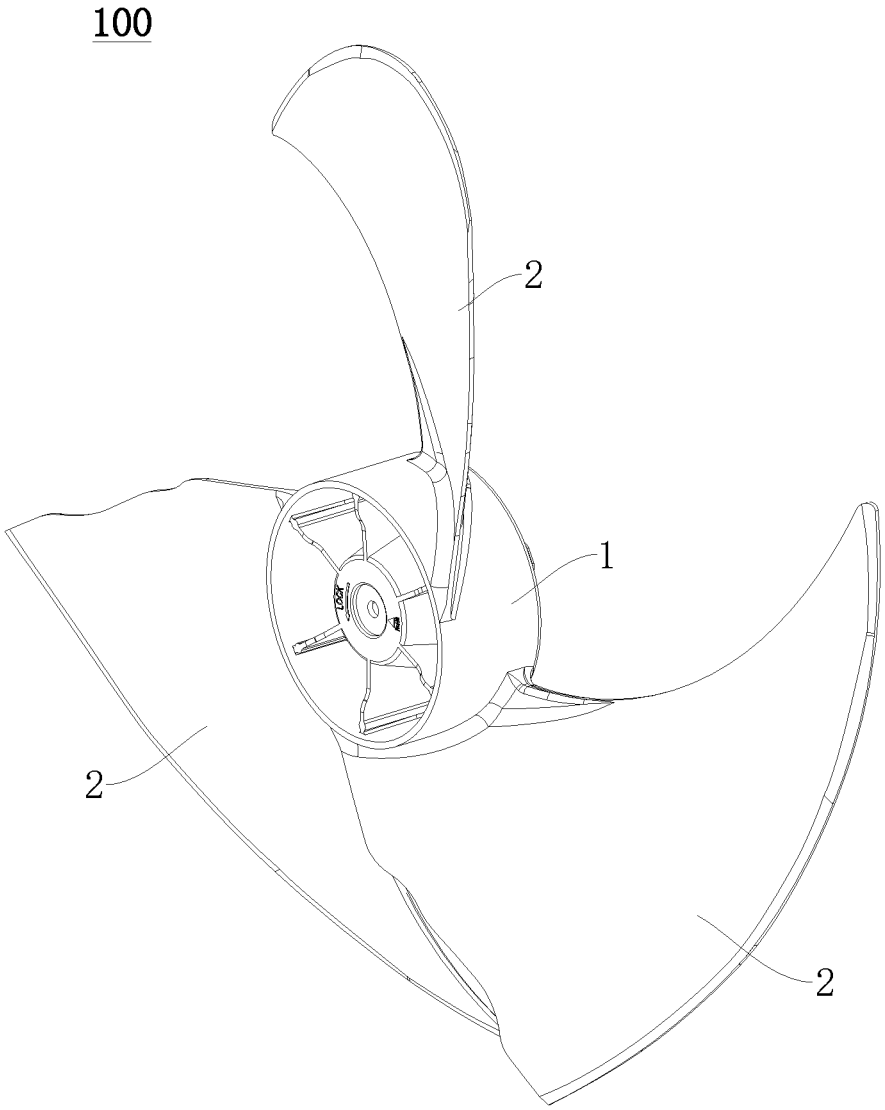
FIG. 10 is a perspective view of an axial-flow impeller according to another embodiment of the present application.

According to some embodiments of the present application, referring to FIGS. 5, 8, and 9, a plurality of stacking bosses 13 are formed at the front end surface of the hub 1, arranged at intervals in the circumferential direction of the hub 1 and located on an outer circumferential side of the fitting groove 12; and when the axial-flow impellers are stacked axially, the stacking boss 13 of one of two adjacent axial-flow impellers 100 is adapted to extend into the hub cavity 11 of the other axial-flow impeller 100 and be fitted with the inner circumferential wall of the hub cavity 11. For example, when transported or stored, the plural axial-flow impellers 100 may be stacked axially, such that an occupied space may be reduced and placement may be stable; and at this point, the plurality of stacking bosses 13 located on the front end surface of the rear axial-flow impeller 100 extend into the hub cavity 11 of the adjacent front axial-flow impeller 100, and are fitted with the inner circumferential wall of the hub cavity 11 of the adjacent front axial-flow impeller 100. Thus, two adjacent axial-flow impellers 100 may be limited radially, and damage to the blade 2 caused by overlarge shakes in the stacking process of the axial-flow impellers 100 may be prevented.

When the axial-flow impellers 100 are required to be used or assembled, two adjacent axial-flow impellers 100 are separated from each other, and the stacking boss 13 of one axial-flow impeller 100 is separated from the hub cavity 11 of the other axial-flow impeller 100, thereby separating the stacked axial-flow impellers 100.

Optionally, 2 to 5 stacking bosses 13 may be formed on the front end surface of the hub 1. For example, referring to FIG. 6, three stacking bosses 13 may be formed on the front end surface of the hub 1 at regular intervals in the circumferential direction of the hub 1, such that two adjacent stacking-fitted axial-flow impellers 100 may be stacked more stably.

Optionally, referring to FIG. 5, each stacking boss 13 may extend in the circumferential direction of the hub 1, thus increasing a contact area between the single stacking boss 13 and the inner circumferential wall of the hub 1, and further improving the stacking stability of two adjacent stacking-fitted axial-flow impellers 100. For example, each stacking boss 13 may be oblong, oval, or the like.

Optionally, referring to FIGS. 1 to 8, the hub boss 14 is provided in the hub cavity 11 and has the outer circumferential wall spaced apart from the inner circumferential wall of the hub cavity 11, the shaft hole 141 suitable for being fitted with the output shaft of the motor is formed in the hub boss 14 and communicated with the fitting groove 12, the plural reinforcing rib plates 15 are arranged between the inner circumferential wall of the hub cavity 11 and the outer circumferential wall of the hub boss 14 at intervals in the circumferential direction of the hub boss 14, a rear end surface of each reinforcing rib plate 15 is located on a front side of the rear end surface of the hub 1, a rear end surface of each reinforcing rib plate 15 and the rear end surface of the hub 1 have a distance d, each stacking boss 13 has a thickness h in a front-rear direction, and $d \geq h$. Thus, the arranged reinforcing rib plate 15 may improve the structural strength of the hub 1; by locating the rear end surface of the reinforcing rib plate 15 on the front side of the rear end surface of the hub 1, a larger accommodation space suitable for accommodating the stacking boss 13 may be released; by setting the distance d between the rear end surfaces of each reinforcing rib plate 15 and the hub 1 to be no less than the thickness h of each stacking boss 13 in the front-rear direction, when the axial-flow impellers 100 are stacked axially, the stacking boss 13 may be accommodated in the hub cavity 11 completely; and since the accommodating space is released on a rear side of the reinforcing rib plate 15, angles and directions are not required to be considered in the stacking process, thus reducing stacking operation procedures.

It should be noted that, in the above-mentioned embodiments, when the axial-flow impellers 100 are stacked, in the front-rear direction, if the stacking boss 13 of the rear axial-flow impeller 100 is just opposite to the reinforcing rib plate 15 of the front axial-flow impeller 100, the front end surface of the stacking boss 13 may abut against the rear end surface of the reinforcing rib plate 15, such that the plural stacked axial-flow impellers 100 may be limited axially, thereby further improving the stacking stability of the axial-flow impellers 100. When the axial-flow impellers 100 are stacked, in the front-rear direction, if the stacking boss 13 of the rear axial-flow impeller 100 is just opposite to a space between the reinforcing rib plates 15 of the front axial-flow impeller 100, the stacking boss 13 may be accommodated right behind the space between two adjacent reinforcing rib plates 15.

In other embodiments, the above-mentioned reinforcing rib plate 15 may extend to the rear end surface of the hub 1, and at this point, the rear end surface of the reinforcing rib plate 15 is flush with the rear end surface of the hub 1, and when the axial-flow impellers 100 are stacked, in the front-rear direction, the stacking boss 13 of the rear axial-flow impeller 100 is required to be opposite to the space between the reinforcing rib plates 15 of the front axial-flow impeller 100, such that the stacking boss 13 is fitted into the space between adjacent reinforcing rib plates 15. Further, two circumferential end surfaces of the stacking boss 13 may abut against the two corresponding reinforcing rib plates, such that the axial-flow impellers 100 may be circumferentially limited to prevent the axial-flow impellers 100 from rotating, thus further improving the stacking stability of the axial-flow impellers 100.

An air-conditioner according to embodiments of a second aspect of the present application includes the axial-flow impeller 100 according to the embodiments of the first aspect of the present application.

In the air-conditioner according to the embodiments of the present application, the arrangement of the above-mentioned axial-flow impeller 100 may reduce the air outlet noise and power.

Optionally, when the air-conditioner includes an air-conditioner indoor unit and an air-conditioner outdoor unit, the above-mentioned axial-flow impeller 100 may be used in the air-conditioner indoor unit or the air-conditioner outdoor unit.

In the description of the present specification, reference throughout this specification to "an embodiment," "some embodiments," "exemplary embodiment," "example," "specific example" or "some examples" means that a particular feature, structure, material, or characteristic described in connection with the embodiment or example is included in at least one embodiment or example of the present application. In the specification, the schematic expressions to the above-mentioned terms are not necessarily referring to the same embodiment or example. Furthermore, the described particular features, structures, materials, or characteristics may be combined in any suitable manner in one or more embodiments or examples.

Although embodiments of the present application have been shown and illustrated, it shall be understood by those skilled in the art that various changes, modifications, alternatives and variants without departing from the principle and idea of the present application are acceptable. The scope of the present application is defined by the claims and their equivalents.

What is claimed is:

1. An axial-flow impeller comprising:

a hub; and a plurality of blades arranged on an outer circumferential wall of the hub at intervals along a circumferential direction of the hub, a tail edge of one blade of the blades being provided with a plurality of recessed portions successively arranged in a direction from a blade root of the one blade to an outer edge of the one blade and each recessed in a direction towards a front edge of the one blade;

wherein:

a connection line between a projection of a starting point of a first recessed portion on a reference plane perpendicular to a rotation axis of the axial-flow impeller and a projection of an end point of a second recessed portion on the reference plane is a first connection line, the first recessed portion being one of the plurality of recessed portion that is closest to the blade root of the one blade, and the second recessed portion is another one of the plurality of recessed portions that is closest to the outer edge of the one blade;

a connection line between a projection of a tail edge point of the blade root on the reference plane and the projection the end point of the second recessed portion on the reference plane is a second connection line;

a projection of each of a first subset of the plurality of recessed portions on the reference plane is partially located at a front-edge side of the second connection line, the front-edge side of the second connection line being one of sides of the second connection line that is close to the front edge, and the first subset including one or more of the plurality of recessed portions;

a projection of each of a second subset of the plurality of recessed portions on the reference plane is completely located between the first connection line and the second connection line, and the second subset including remaining one or more of the plurality of recessed portions; and a blade root of at least one blade of the blades includes a thickened portion close to a front edge of the at least one blade.

2. The axial-flow impeller according to claim 1, wherein:

the hub has a front end surface and a rear end surface in an airflow incoming direction, the front end surface being closed and the rear end surface being open;

a hub cavity with an open rear end is formed in the hub; and a fitting groove suitable configured to be fitted with a motor is provided on the front end surface.

3. The axial-flow impeller according to claim 2, wherein:

a hub boss is provided in the hub cavity, an outer circumferential wall of the hub boss being spaced apart from an inner circumferential wall of the hub cavity; and a shaft hole configured to be fitted with an output shaft of the motor is formed at the hub boss and communicated with the fitting groove.

4. The axial-flow impeller according to claim 3, wherein a plurality of reinforcing rib plates are arranged between the inner circumferential wall of the hub cavity and the outer circumferential wall of the hub boss at intervals along a circumferential direction of the hub boss.

5. The axial-flow impeller according to claim 4, wherein each of the reinforcing rib plates is connected with the outer circumferential wall of the hub boss, the inner circumferential wall of the hub cavity, and a front end wall of the hub cavity.

6. The axial-flow impeller according to claim 1, wherein the first subset of the plurality of recessed portions include the second recessed portion.

7. The axial-flow impeller according to claim 6, wherein a projection of a furthest contour point of the second recessed portion on the reference plane is located on the front-edge side of the second connection line, the furthest contour point is a point on a contour line of the second recessed portion that is furthest from the second connection line.

8. The axial-flow impeller according to claim 1, wherein the second subset of the plurality of recessed portions include the first recessed portion.

9. The axial-flow impeller according to claim 1, wherein a projection of one recessed portion of the plurality of recessed portions on the reference plane is a curve, and the one recessed portion is smoothly and transitionally connected to a part of the tail edge other than the one recessed portion.

10. The axial-flow impeller according to claim 1, wherein a projection of a part of the tail edge located between two adjacent ones of the plurality of recessed portions is a straight line.

11. The axial-flow impeller according to claim 1, wherein at least one of the blades includes a thinned region spaced apart from the front edge and the outer edge of the at least one blade, and the thinned region has a thickness less than a thickness of other regions of the at least one of the blades other than the thinned region.

12. The axial-flow impeller according to claim 1, wherein the thickened portion is provided at a pressure surface of the at least one blade.

13. The axial-flow impeller according to claim 1, wherein in a direction from the hub to an outer edge of the at least one blade, a thickness of the thickened portion reduces gradually, the thickness of the thickened portion being a size of the thickened portion in a thickness direction of the at least one blade.

14. The axial-flow impeller according to claim 1, wherein in a direction from the hub to an outer edge of the at least one blade, a width of the thickened portion reduces gradually, the width of the thickened portion being a size of the thickened portion in a circumferential direction of the at least one hub.

15. The axial-flow impeller according to claim 3, wherein in a direction from the front end surface to the rear end surface of the hub, the outer circumferential wall of the hub boss extends obliquely in a direction towards a central axis of the hub.

16. The axial-flow impeller according to claim 2, wherein:

a plurality of stacking bosses are formed on the front end surface of the hub, arranged at intervals along a circumferential direction of the hub, and located at an outer circumferential side of the fitting groove; and when the axial-flow impeller is stacked axially to another axial-flow impeller, the stacking bosses of one of the axial-flow impeller and the other axial-flow impeller extend into the hub cavity of another one of the axial-flow impeller and the other axial-flow impeller and are fitted with the inner circumferential wall of the hub cavity of the other one of the axial-flow impeller and the other axial-flow impeller.

17. The axial-flow impeller according to claim 16, wherein each of the stacking bosses extends along the circumferential direction of the hub.

18. The axial-flow impeller according to claim 16, wherein:

a hub boss is provided in the hub cavity, an outer circumferential wall of the hub boss being spaced apart from an inner circumferential wall of the hub cavity;

a shaft hole configured to be fitted with an output shaft of a motor is formed on the hub boss and communicated with the fitting groove;

a plural reinforcing rib plates are arranged between the inner circumferential wall of the hub cavity and the outer circumferential wall of the hub boss at intervals along a circumferential direction of the hub boss, a rear end surface of each of the reinforcing rib plates being located at a front side of the rear end surface of the hub, a distance between the rear end surface of each of the reinforcing rib plates and the rear end surface of the hub is not less than a thickness of each of the stacking bosses in a front-rear direction.

19. An air-conditioner comprising:

an axial-flow impeller including:

a hub; and a plurality of blades arranged on an outer circumferential wall of the hub at intervals along a circumferential direction of the hub, a tail edge of one blade of the blades being provided with a plurality of recessed portions successively arranged in a direction from a blade root of the one blade to an outer edge of the one blade and each recessed in a direction towards a front edge of the one blade;

wherein:

a connection line between a projection of a starting point of a first recessed portion on a reference plane perpendicular to a rotation axis of the axial-flow impeller and a projection of an end point of a second recessed portion on the reference plane is a first connection line, the first recessed portion being one of the plurality of recessed portion that is closest to the blade root of the one blade, and the second recessed portion is another one of the plurality of recessed portions that is closest to the outer edge of the one blade;

a connection line between a projection of a tail edge point of the blade root on the reference plane and the projection the end point of the second recessed portion on the reference plane is a second connection line;

a projection of each of a first subset of the plurality of recessed portions on the reference plane is partially located at a front-edge side of the second connection line, the front-edge side of the second connection line being one of sides of the second connection line that is close to the front edge, and the first subset including one or more of the plurality of recessed portions; and a projection of each of a second subset of the plurality of recessed portions on the reference plane is completely located between the first connection line and the second connection line, and the second subset including remaining one or more of the plurality of recessed portions; and a blade root of at least one blade of the blades includes a thickened portion close to a front edge of the at least one blade.

* * * * *